United States Patent [19]

Lukens

[11] 4,059,936

[45] Nov. 29, 1977

[54] PANEL CONSTRUCTION FOR ROOFS AND THE LIKE

[75] Inventor: Edward E. Lukens, Bethlehem, Pa.

[73] Assignee: Insuldeck Corporation, Bath, Pa.

[21] Appl. No.: 727,170

[22] Filed: Sept. 27, 1976

[51] Int. Cl.[2] ..... E04B 5/52

[52] U.S. Cl. ..... 52/492; 52/310; 52/620; 52/622

[58] Field of Search ..... 52/480, 620, 617, 615, 52/624, 492, 622, 595, 404, 583, 601, 302, 310

[56] References Cited

U.S. PATENT DOCUMENTS

| | | | |
|---|---|---|---|
| 2,014,841 | 9/1935 | Heeren et al. | 52/601 X |
| 2,021,922 | 11/1935 | Peck | 52/601 |
| 3,203,146 | 8/1965 | Carter | 52/310 X |
| 3,313,073 | 4/1967 | Mathews | 52/617 X |
| 3,357,146 | 12/1967 | Gartrell | 52/620 X |

*Primary Examiner*—Price C. Faw, Jr.
*Assistant Examiner*—Carl D. Friedman
*Attorney, Agent, or Firm*—Zachary T. Wobensmith, 2nd; Zachary T. Wobensmith, III

[57] ABSTRACT

A panel construction for roofs and the like is disclosed for use as an insulated structural roof deck and insulated structural wall which includes panels capable of being readily handled, the panels being attached to and supported by spaced long span bar joints or the like, or other structural steel framing, the panels each having a lower board preferably of gypsum to serve as a fire shield and to which at least one small structural steel stiffener or joist member preferably of I-shape and of sheet metal is secured. I-shaped joist members are also provided along one end margin and along one edge margin of each panel. The space between the internal joists and to the I-shaped margin members is filled with polyurethane foam formed along one side edge and one end edge as tongues for engagement in the I-shaped margin members. The lower board is preferably vented to permit the escape of gas generated by exposure of the foam to very high temperatures. The panel is held in place in several different ways, depending upon the desired resistance to fire.

The panel has great strength and resistance to distributed load, low deflection, is light in weight, is effective for heat and sound insulation, can be readily sealed at its edges in engagement with edges of adjoining panels, and is suitable for use as roof or floor panels or as vertical wall members, and for the reception of various wall members, coatings or treatments.

14 Claims, 10 Drawing Figures

PANEL CONSTRUCTION FOR ROOFS AND THE LIKE

BACKGROUND OF THE INVENTION

1. Field of the Invention

This invention relates to a panel construction and more particularly to panels for use in building construction for roofs, floors and other purposes.

2. Description of the Prior Art

Various panels have heretofore been proposed but these have had serious practical limitations.

Vetz, in U.S. Pat. No. 3,484,331, shows a foamed plastic plate in which sheet members are employed with top and bottom flanges connected by wires and the interior filled with foamed material which is exposed at the top and bottom. The end sheet metal members do not provide satisfactory joints either as to water tightness or heat or sound insulation. The panel is also lacking in any protection against fire.

Weismann, in U.S. Pat. No. 3,305,991, shows reinforced modular foam panels in which stabilized foam of polystyrene or polyurethane is adherent to and reinforced by internal lattices of light wire. The panel may be mounted on a poured concrete slab and one or both faces plastered. The panel of Weismann lacks adequate strength for use as a roof or floor panel and is not fire resistant.

Beckwith, in U.S. Pat. No. 2,029,352 shows a reinforced insulating roof slab in which exterior facing panels of asbestos and Portland cement have an insulating filling in semi-rigid form such as cane fiber board or of bonded asbestos fiber of mineral wool in semi-rigid blocks, or of loose felting material, or of other materials. Beckwith mentions the use of internal reinforcing bars of metal or of wood and edge reinforcing strip to face and to protect the core and to reinforce the panel. The edge reinforcing strip may be shaped to provide a shiplap or a groove to receive a spline. The Beckwith structure is heavy, has the internal reinforcing strips disposed in a different fashion, has a different end and edge construction and lacks the protective features of the internal reinforcing and of the lower panel section found in applicant's construction.

Mathews, in U.S. Pat. No. 3,305,986, shows laminated panels in which two outside covers of zinc coated steel have polyurethane foam therebetween and tongue and groove edges. Mathews does not disclose a structure which could be used for the purposes of the panels of the present invention.

Nicosia, in U.S. Pat. No. 3,562,985, shows a reinforced synthetic resin structural panel in which a vertical panel has ceiling and floor supports shown as elongated U-shaped brackets fastened to the floor and ceiling with a central vertical reinforcing screen embedded in a foam synthetic resin body, the exterior faces of the body being covered by a thin asbestos covering or a surface coating.

Nicosia does not disclose the panel construction of applicant nor the end and edge features nor the same internal reinforcement nor the retention of gypsum board.

Peck, in U.S. Pat. No. 2,021,922, shows a metal edged slab and building construction in which a single end I-beam furnishes a socket for the end of a panel of cementitious material such as gypsum, but does not disclose a composite panel with comparable internal reinforcement, nor end and edge joint construction comparable to that herein disclosed, nor gypsum board retention for fire protection.

Raynes, in U.S. Pat. No. 3,336,710, shows a fire resistant wall panel in which gypsum wall boards have polystyrene foam disposed therebetween and with further gypsum wall board or cement covering.

Raynes does not show a light weight panel, does not disclose any comparable internal reinforcement, does not show any comparable edge and end construction, does not have any comparable gypsum board retention and does not have a panel capable of use for the purposes of the panel herein disclosed.

It has also been proposed to employ gypsum board with a tongue and groove aluminum edge molding but this is objectionable because of the heat transmission by the edge molding.

It has also been proposed to employ tapered urethane roof panels in various sizes up to 4 feet by 12 feet and with tapers of one-eighth, one-quarter, and one-half inch per foot with a top skin of felt, kraft, or foil paper, and with a bottom skin of perlite, fire rated gypsum or felt. These panels are particularly susceptible to delamination and do not meet the Factory Mutual Class 1 or Underwriter's Laboratories Class A requirements for fire and uplift ratings for the roof deck and insulation components of roofing systems.

Other roof and floor panels now available are excessively heavy so that special hoisting equipment is required to mount the panels in place. The roof and floor panels now available are inadequate as to heat and sound insulation, are not fireproof or adequately fire resistant or have other shortcomings.

SUMMARY OF THE INVENTION

In accordance with the invention a light weight modular panel is provided having a rigid lower face lamina preferably of fire rated gypsum board, with gas venting provisions, with at least one longitudinally disposed I-beam of sheet metal secured thereto intermediate the side edges, an I-beam of sheet metal being disposed at one longitudinal edge, an I-beam of sheet metal being mounted on the gypsum board at one end, the spaces between the longitudinal I-beams and bounded by the I-beam at one end being filled with a stabilized foam of polyurethane or polyimide which is adherent to the gypsum board and to the I-beams. The edge I-beam is retained on a supporting joist by clips, strips or by retaining portions formed integral with the edge I-beam.

It is the principal object of the invention to provide a structural panel with heat and sound insulating properties which can be quickly and inexpensively produced, which can be easily handled and installed and which has a long useful life.

It is a further object of the invention to provide a structural panel construction having a plastic foam component and a gypsum board component to retain its integrity under fire exposure when excessive pressures would otherwise occur with venting of the gypsum board in the event of gas formation in the plastic foam component.

It is a further object of the invention to provide a panel resistant to distributed load and which will not deflect excessively within its load limits.

It is a further object of the invention to provide a panel for building construction which can be quickly secured in place on spaced supports, such as I-beams or bar joists.

It is a further object of the invention to provide a panel which in at least one embodiment will meet or exceed Factory Mutual Class 1 and Underwriter's Laboratories Class A requirements for fire and uplift ratings for roof deck and insulation components of roofing systems.

Other objects and advantageous features of the invention will be apparent from the description and claims.

BRIEF DESCRIPTION OF THE DRAWINGS

The nature and characteristic features of the invention will be more readily understood from the following description taken in connection with the accompanying drawings forming part thereof, in which.

Figure 1:
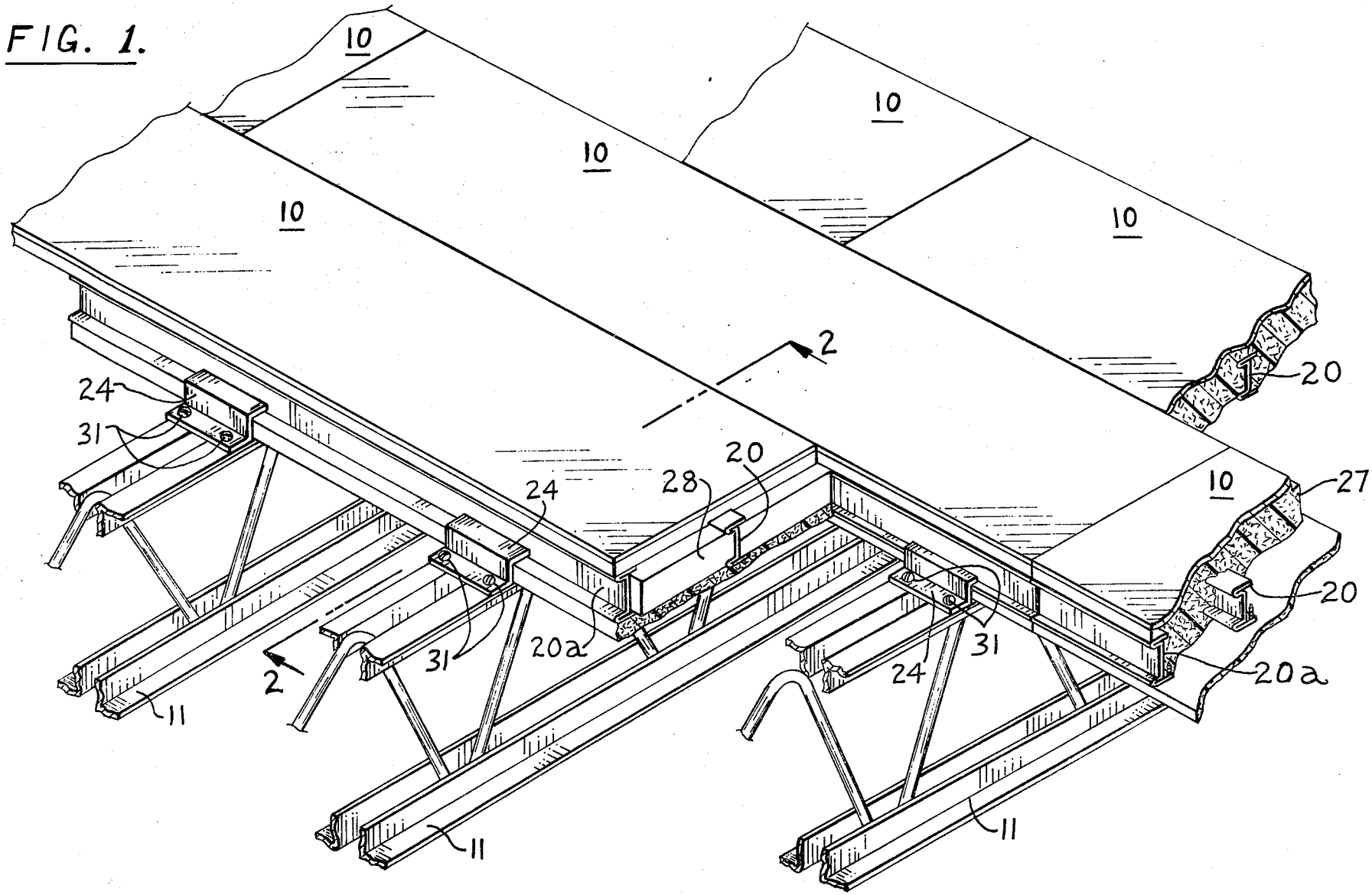
FIG. 1 is a view in perspective showing an assembly of a plurality of panels in accordance with the invention.

It should, of course, be understood that the description and drawings herein are illustrative merely and that various modifications and changes can be made in the structure disclosed without departing from the spirit of the invention.

Like numerals refer to like parts throughout the several views.

DESCRIPTION OF THE PREFERRED EMBODIMENTS

Referring now more particularly to FIGS. 1, 2, 2A and 3 of the drawings, the panels 10 as therein illustrated are rectangular in shape, are supported on joists or I-beams 11 with their contiguous ends and edges in engagement, and along one of their longitudinal edges are secured to contiguous I-beams 11, as hereinafter described.

The spacing of the joists or I-beams 11 is dependent upon the requirements of a specific installation and can be on 4 foot, 5 foot, 6 foot 8 inches, or other centers, as required.

Each of the panels 10 preferably includes a lower lamina 14, and a lamina 15 thereabove. The lower lamina 14 is preferably a fire rated gypsum board and in a particular embodiment can advantageously have a thickness of one half inch to five-eighths of an inch. The lamina 14 preferably has a lower paper covering 17 and an upper paper covering 18. An upper impact sheet or board 19 of any desired material can be provided to protect the lamina 15, or any other suitable material may be employed.

The lamina 15 is preferably of stabilized synthetic plastic foam, which may be of polyurethane, of polyimide or of urea formaldehyde. The lamina 15 in a preferred embodiment is of a density of the order of 2 pounds per cubic foot.

Within the lamina 15, spaced downwardly below the top of the lamina 15, and in engagement with the upper covering 18 of the lamina 14, and between the longitudinal edges of the panels 10 at least one I-beam 20 is provided of a height in a particular embodiment of the order of two and one fourth inches, formed of sheet metal, 18 gage steel being suitable for some panels although for shorter or longer spans it can be 20 or 16 gage, so long as the deflection of the panel 10 is not excessive. The deflection preferably does not exceed 1/180 of the length of the span.

The panel 10, along one longitudinal edge is provided with an I-beam **20*a* similar to and parallel to the I-beam 20 and in one embodiment may include a horizontal flange 21**.

Each panel 10 at one end (see FIGS. 5 and 7) is provided with an I-beam 26 with the same configuration as the I-beam 20 and engaged with the upper covering 18.

The plastic foam of the lamina 15 is molded in a well known manner and so as to be adherent to the upper covering 18 of the lamina 14 as well as the lower face of the impact sheet or board 19 and the longitudinal I-beams 20 and **20*a* and the transverse end I-beam 26. The plastic foam of the lamina 15 has along the longitudinal edge opposite to the I-beam 20*a* and along the end edge opposite to the I-beam 26, tongues 27 and 28 for engagement respectively in the edge and end channels along the I-beams 20*a* and 26**.

The lamina 14 has a plurality of supporting and securing fasteners 30 extending therethrough from the lower covering 17 and through and engaging the lower flanges of the I-beams 20, **20*a* and 26**. For this purpose self-drilling, self-tapping screws can be employed.

Figure 2A:
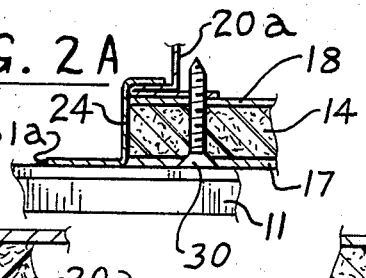
FIG. 2A is a modified form of the structure of FIG. 2 in which the clip is welded to the supporting joist.
Figure 2:
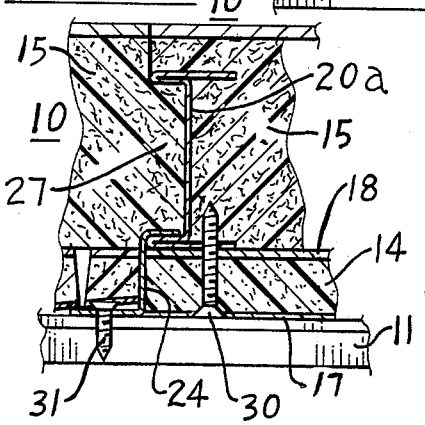
FIG. 2 is a vertical sectional view, enlarged, taken approximately on the line 2—2 of FIG. 1 and showing the panel held to a supporting joist by a clip and screw engaging the joist.

The panels 10 are supported on the joists or I-beams 11 and preferably are secured in place, as shown in FIGS. 1 and 2, by clips 24 which engage the lower flanges of the I-beams **20*a* and the upper faces of the beams 11. Fasteners 31, such as self-tapping screws, which extend through the clips 24 and into the beams 11 hold the clips 24 in place. If desired, and as shown in FIG. 2A the clips 24 may be welded to the beams 11 as at 31*a***.

The use of the clips 24 minimizes the heat transfer upwardly and into the foam lamina 15 in the event of exposure to fire from below.

The panels 10 can be of any desired size but for ease of installation it is preferred that the panels 10 have a width of about 30 inches or about 750 mm and a length of about 12 feet or about 4 meters.

Figure 3:
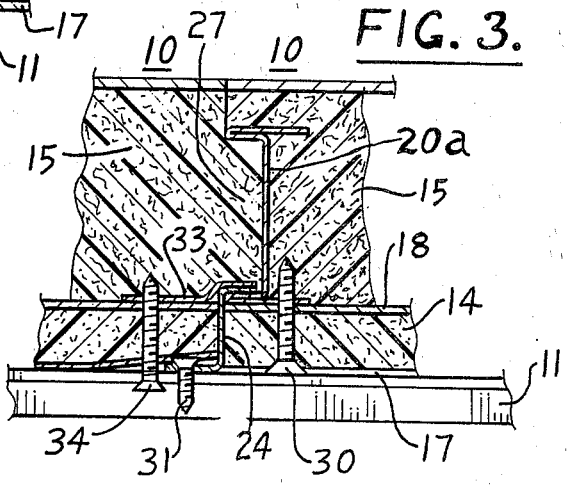
FIG. 3 is a fragmentary sectional view showing the preferred mode of retaining the gypsum board during fire exposure and in its relation with another form of hold down.

As shown in FIG. 3, the tongue 27 can have a liner strip 33 extending therealong, and secured in place by spaced fasteners 34, such as self-tapping screws. The liner strip 33, in place, will bear on the lower flange of the I-beam **20*a* and where supporting joists or I-beams 11 occur will squeeze up over the hold down clips 24**.

Figure 4:
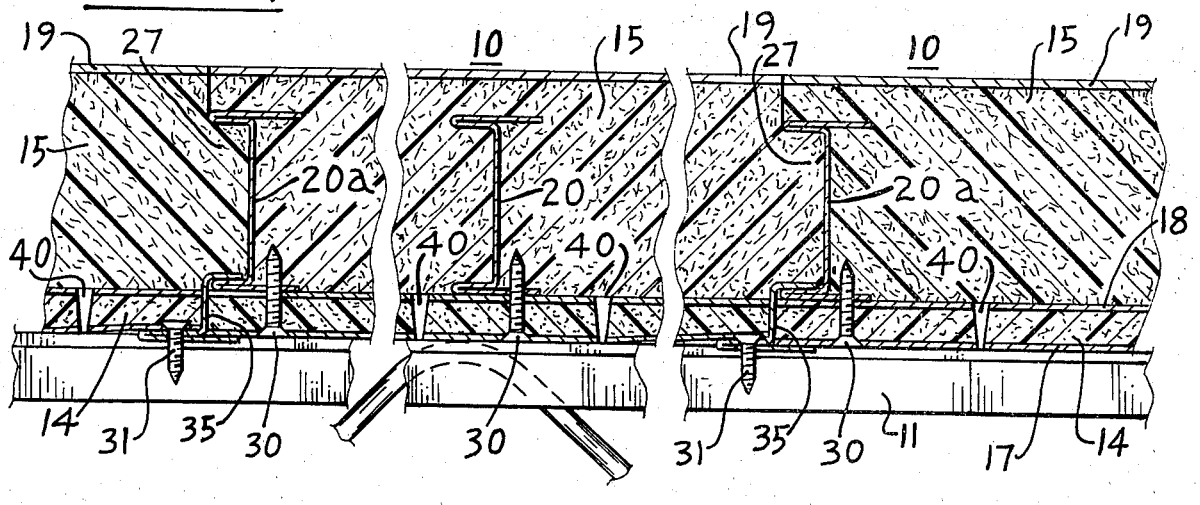
FIG. 4 is a vertical sectional view, enlarged, taken transversely through a plurality of panels and showing a different form of panel hold down.
Figure 5:
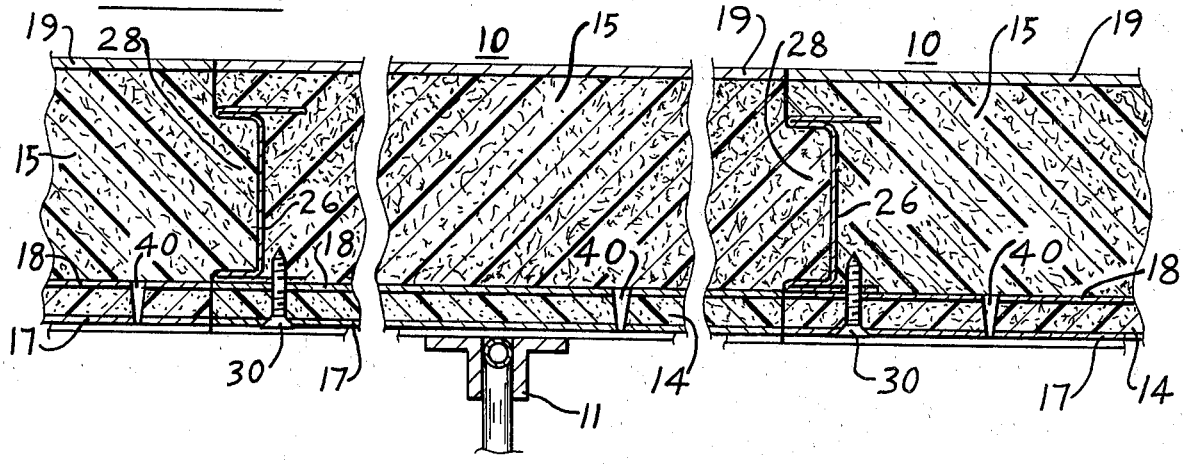
FIG. 5 is a vertical longitudinal sectional view of the panels of FIG. 4.

In FIGS. 4 and 5 a modified form of the invention is illustrated in which the edge I-beams **20*a* have separate panel retainers 35 which extend along the edge I-beams 20*a*, engage the lower flanges of these I-beams 20*a* and are secured in place on each of the beams 11 by fastening devices 31**, such as self-tapping screws.

Figure 6:
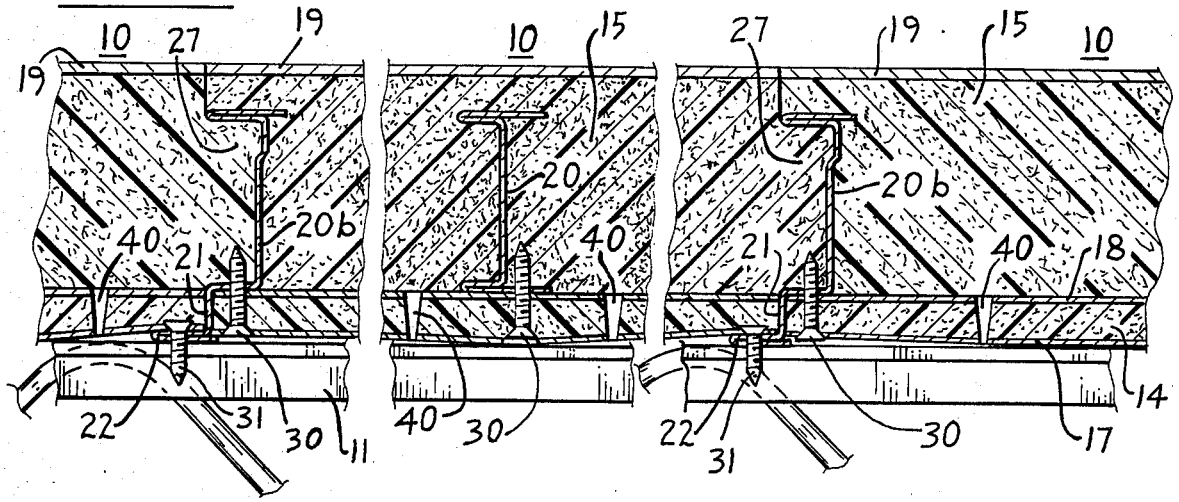
FIG. 6 is a vertical transverse sectional view similar to FIG. 4 but showing a different form of panel hold down.
Figure 7:
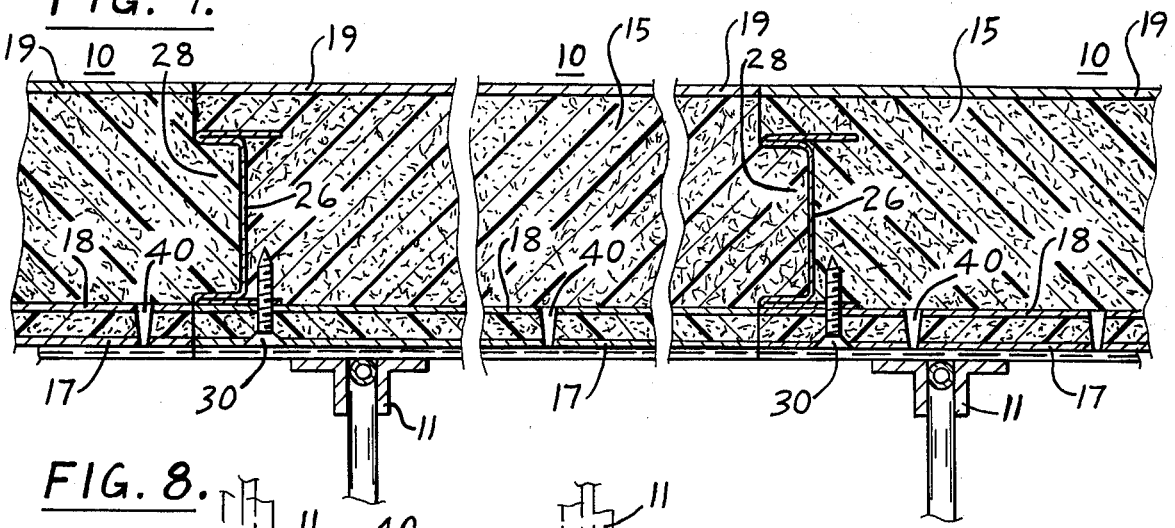
FIG. 7 is a vertical longitudinal sectional view of the panels of FIG. 6.

In FIGS. 6 and 7 a modified form of the invention is shown in which the edge I-beams **20*b* have an integral vertically downwardly extending wall portion 21 with a horizontally extending retainer portion 22 which is secured to the joist 11 by a fastener 31 similar to that shown in FIGS. 1 and 2**.

Figure 8:
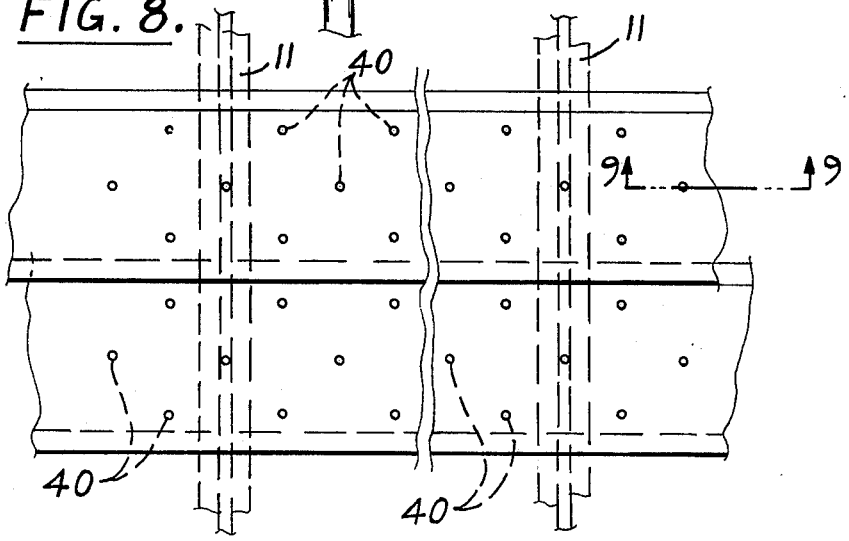
FIG. 8 is a fragmentary plan view showing one arrangement of venting holes in the lower lamina.

In order to retain the effectiveness of the lamina 14 in the event of exposure to high heats, such as those attendant upon a fire below, the lamina 14 is preferably provided with a plurality of vent openings 40 which can be spaced as indicated in FIG. 8.

Figure 9:
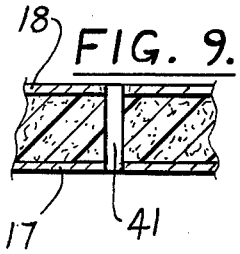
FIG. 9 is a fragmentary vertical sectional view showing a different shape of venting hole.

The vent openings 40 can be tapered or conical, and extend through the lower covering 17 of the lamina 14 so that upon the application of pressure gas will force its way out. If desired, the openings 40 can be cylindrical, as at 41 (see FIG. 9) and extend through the lower covering 17.

In use, one of the panels 10 is secured in place on the joists or beams 11 by welding as at **31*a* or by the fasteners 31. The next panel 10 is assembled to a previously secured panel by engaging its edge tongue 27 or end tongue 28 in the channel in the contiguous edge I-beams 20*a* and 20*b*, or end I-beams 26, forcing it into engagement and then securing it in place on the joists or I-beams 11. The area to be covered has panels 10** placed thereover and secured in place.

It will thus be seen that a panel construction is provided which is relatively light in weight yet strong when assembled, which provides good heat and sound insulation, which has improved retention of the lamina 14 and is fire resistant.

I claim:

1. A panel of generally rectangular shape for use in building construction and for attachment to a support comprising a first lower fire resistant gypsum board lamina, a second lamina superposed thereon in adherent relation thereto, said second lamina being of stabilized plastic foam and having embedded therein between the side edges a longitudinally extending steel I-beam with its lower flanges engaged with a face of the first lamina and held in engagement therewith by said second lamina, the upper flanges of said longitudinally extending I-beam being interiorly disposed below the face of said second lamina opposite to that engaged with the face of the first lamina, the second lamina being in covering relation to said upper flanges, said second lamina having a tongue along one longitudinal edge thereof, said second lamina having in secured engagement along an opposite edge face a steel I-beam having its lower flanges in the same plane as the lower flanges of the first mentioned I-beam and its upper flanges in the same plane as the upper flanges of the first mentioned I-beam and having a longitudinal edge providing a groove for the reception of an edge tongue of an adjoining panel, and members for securing said second mentioned I-beam in place on the support.

2. A panel as defined in claim 1 in which said last mentioned members are clips.

3. A panel as defined in claim 2 in which said clips are in engagement with a flange of said second mentioned I-beam.

4. A panel as defined in claim 1 in which said last mentioned members have a flange portion in engagement with a flange portion of said second mentioned I-beam.

5. A panel as defined in claim 1 in which said last mentioned members are integral with said second mentioned I-beam.

6. A panel as defined in claim 1 in which end edges of said panel have complemental portions for engagement with an adjoining panel.

7. A panel as defined in claim 1 in which one end edge of said panel has an I-beam therealong with an exterior channel.

8. A panel as defined in claim 7 in which the other end edge of said panel has a tongue complemental to the channel of said one edge.

9. A panel as defined in claim 1 in which one end edge of said panel has a tongue for engagement with a complemental edge of an adjoining panel.

10. A panel as defined in claim 1 in which said last mentioned members include a horizontal flange portion for panel hold down.

11. A panel as defined in claim 1 in which said I-beams are of sheet metal.

12. A panel as defined in claim 1 in which an impact lamina is superposed on said second lamina, and said second lamina is in adherent engagement with said impact lamina.

13. A panel as defined in claim 1 in which said lower lamina has a plurality of vent openings.

14. A panel as defined in claim 1 in which said edge tongue has a liner strip therealong.

* * * * *